US005299398A

United States Patent [19]

Goldstein

[11] Patent Number: 5,299,398

[45] Date of Patent: Apr. 5, 1994

[54] METHOD AND KIT FOR ASSEMBLY OF BLIND WINDOW FRAMES

[76] Inventor: Avner Goldstein, 6 Hápalmach St., Azor, Israel

[21] Appl. No.: 882,963

[22] Filed: May 14, 1992

[30] Foreign Application Priority Data

May 16, 1991 [IL] Israel ..... 98171

[51] Int. Cl.[5] ..... E06B 1/04

[52] U.S. Cl. ..... 52/204.1; 52/656.1; 52/213; 52/745.2

[58] Field of Search ..... 52/656, 204, 213, 204.1, 52/656.1, 213, 745.2; 49/505; 403/294, 402

[56] References Cited

U.S. PATENT DOCUMENTS

| | | | |
|---|---|---|---|
| 3,591,992 | 7/1971 | Pawlicki | 52/656 |
| 3,690,082 | 9/1972 | Byland | 52/213 |
| 3,715,136 | 2/1973 | Yoshida | 403/294 |
| 4,074,480 | 2/1978 | Burton | 52/790 |
| 4,193,238 | 3/1980 | Chalmers et al. | 52/656 |
| 4,596,488 | 6/1986 | Schendan | 403/402 |
| 4,694,612 | 9/1987 | Pruden et al. | 49/504 |

FOREIGN PATENT DOCUMENTS

| | | | |
|---|---|---|---|
| 722413 | 11/1965 | Canada | 52/213 |
| 2516585 | 5/1983 | France | 52/204 |
| 2064699 | 6/1981 | United Kingdom | 403/294 |
| 2115864 | 9/1983 | United Kingdom | 52/204 |
| 2150184 | 6/1985 | United Kingdom | 52/204 |

*Primary Examiner*—Carl D. Friedman
*Assistant Examiner*—Christopher T. Kent
*Attorney, Agent, or Firm*—Edward Langer

[57] ABSTRACT

A blind window frame provided as a kit for assembly on site, for installation in a wall opening, including a multiplicity of substantially planar frame members. Each frame member has end portions wherein an end portion of one of the frame members abuts an end portion of another of the frame members, and the frame members are fastened to one another. The frame members are cut from a blind window frame bar having a generally flattened U-shaped profile and at least one leg configured to provide a dovetail-shaped railing. A generally L-shaped fastener is used to fasten the abutting blind window frame members at substantially right angles to one another, to form an assembled frame. The kit also includes an interlocking connector for interlocking blind window frame members of assembled frames which are mounted adjacent and offset from one another. The kit also includes anchoring apparatus for anchoring a blind window frame to a wall.

13 Claims, 5 Drawing Sheets

METHOD AND KIT FOR ASSEMBLY OF BLIND WINDOW FRAMES

FIELD OF THE INVENTION

The present invention relates to blind window frames and a method of assembly thereof, allowing for on-site assembly.

BACKGROUND OF THE INVENTION

In recent years wooden windows and window frames have been replaced by metal "blind" window frames, which are metal frames installed in a window opening, onto which an aluminum profile holding the glass window is mounted. The term "blind" window frames refers to the fact that the frames are concealed behind the aluminum profile.

The blind window frames are typically assembled remote from a construction site according to the dimensions specified in the site's building plan. Their assembly mainly comprises the steps of dividing a blind window frame bar into required lengths and welding the lengths to form the window frame shape. After assembly, the blind window frames are transported from the place of manufacture to the construction site where they are installed in correspondingly sized apertures in the walls of the building.

The current method of assembly of metal blind window frames suffers from several disadvantages. First, it is expensive to transport the frames in their assembled state from the place of manufacture to the construction site. Second, it is labor intensive to move them on the building site.

Therefore, there exists a need for a more cost efficient and convenient method for assembling blind window frames at the construction site.

SUMMARY OF THE INVENTION

It is thus an object of the invention to provide a more convenient method for assembling blind window frames.

It is a further object of the invention to provide elements for the assembly of a blind window frame.

There is thus provided, in accordance with a preferred embodiment of the present invention, a blind window frame for installation in a wall opening, including a multiplicity of substantially planar frame members each having end portions wherein an end portion of one of the frame members abuts an end portion of another of the frame members, and fastening apparatus for fastening the end portions of the abutting frame members to one another.

There is further provided in accordance with a Preferred embodiment of the invention a kit for assembling blind window frames including a blind window frame bar for producing blind window frame members therefrom and fastening apparatus for fastening end portions of abutting blind window frame members to one another.

In accordance with a preferred embodiment of the invention, the blind window frame bar has a generally flattened U-shaped profile and at least one leg configured to provide a railing The railing is preferably dovetail shaped. The bars are preferably provided in widths in the range of 20–150 mm.

Further in accordance with a preferred embodiment of the invention, the fastening apparatus includes a generally L-shaped fastener having arms received by the railings of the abutting blind window frame members such that the abutting blind window frame members are fastened at substantially right angles to one another, to form an assembled frame. Preferably the arms of the L-shaped fastener are flanged.

Additionally in accordance with a preferred embodiment of the invention, the kit also includes interlocking apparatus for interlocking blind window frame members of assembled frames which are mounted adjacent and offset from one another. The interlocking apparatus includes a double, truncated-cone connector where the truncated cones are received by the railings of adjacent blind window frame members of assembled frames.

Further in accordance with a preferred embodiment of the present invention the kit also includes anchoring apparatus for anchoring a blind window frame to a wall. The anchoring apparatus includes an anchor having an end configured to be received by the railing of a blind window frame member and a leg to be attached to a wall.

There is still further provided in accordance with the teachings of the invention a method for assembling a blind window frame including the steps of producing blind window frame members from a blind window frame bar and fastening the ends of abutting blind window frame members to one another to form a blind window frame.

In accordance with a preferred method of the invention the blind window frame is anchored to a wall by inserting an anchor into a railing of a blind window frame member, sliding the anchor along the railing to a predetermined position and attaching a leg of the anchor to the wall by methods known in the art.

Additionally in accordance with a preferred method of the invention, adjacent blind window frame members can be interlocked by inserting a connector into the railing of one of the blind window frame members and threading the railing of the other blind window frame member thereon.

Further in accordance with a preferred method of the invention, the fasteners are kept in place by crimping the railing overlying them. The anchors and the connectors are kept in place by crimping the railing on either side thereof.

BRIEF DESCRIPTION OF THE DRAWINGS

Further features of construction and advantages of the invention will become clearer in light of the following description of preferred embodiments thereof, given with reference to the accompanying drawings where similar elements are similarly designated, wherein.

DETAILED DESCRIPTION OF THE PREFERRED EMBODIMENT

Figure 1:
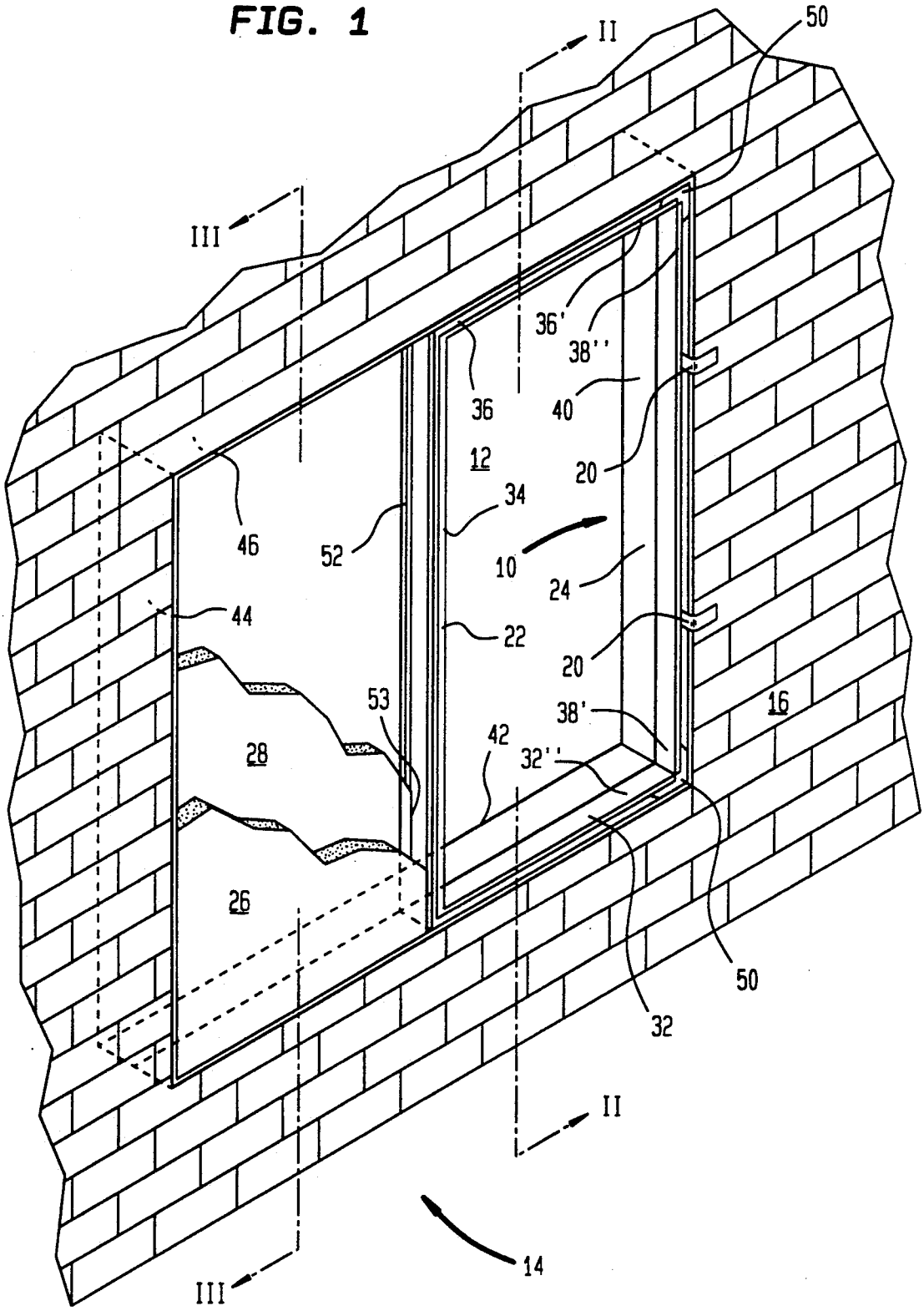
FIG. 1 is a perspective, partial cut away illustration of a blind pocket window frame according to a first embodiment of the present invention.
Figure 2:
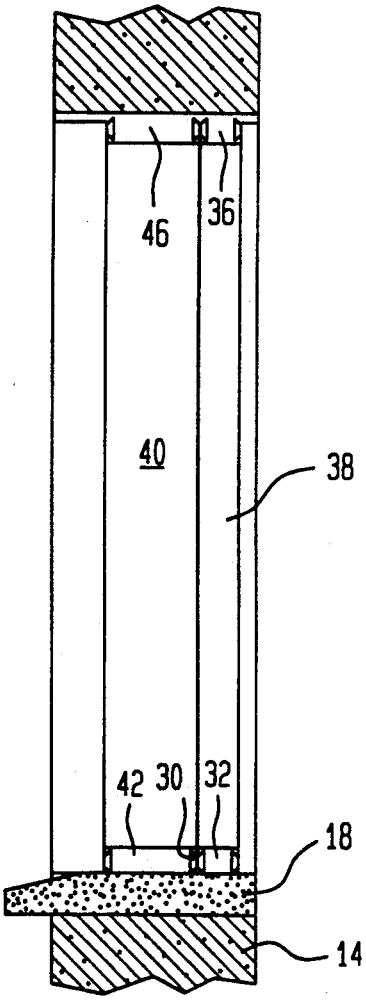
FIG. 2 is a cross sectional illustration of the blind pocket window frame of FIG. 1 taken along section line II—II.
Figure 3:
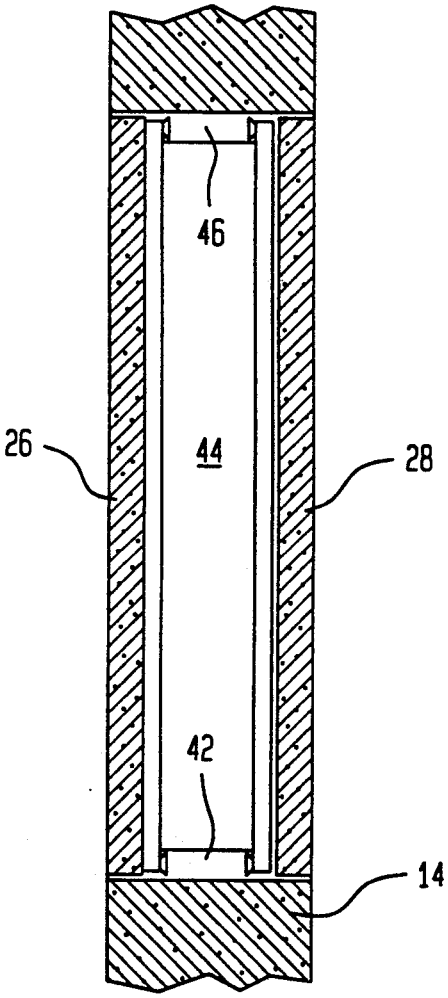
FIG. 3 is a cross-sectional illustration of the blind pocket window frame of FIG. 1 taken along section line III—III.

With reference to FIGS. 1–3, there is shown a blind pocket window frame, generally denoted by 10, which is assembled according to the teachings of the present invention. The blind window frame 10 is normally rectangular-shaped and is typically constructed from galvanized steel having a thickness of 1 mm.

Typically, the blind window frame 10 is installed in an opening 12 prepared in a wall generally denoted 14 comprising blocks 16. A window sill 18, typically of concrete, is prepared to provide a uniform, flat surface for the blind window frame 10. The blind window frame 10 is attached to the wall 14 by anchors 20 best seen and described below with reference to FIG. 6C.

The blind pocket window frame 10 comprises an inner case 22 which defines the window aperture and a peripheral case 24 which defines the window opening 12. The portion of the peripheral case 24 which extends beyond the inner case 22 is concealed by inner partition 26 and outer partition 28, normally of concrete, which are associated with wall 14. The space defined between the partitions 26–28 forms a "pocket" which receives a window slidably mounted on a profile (not shown) installed on the peripheral case 24.

Figure 6A:
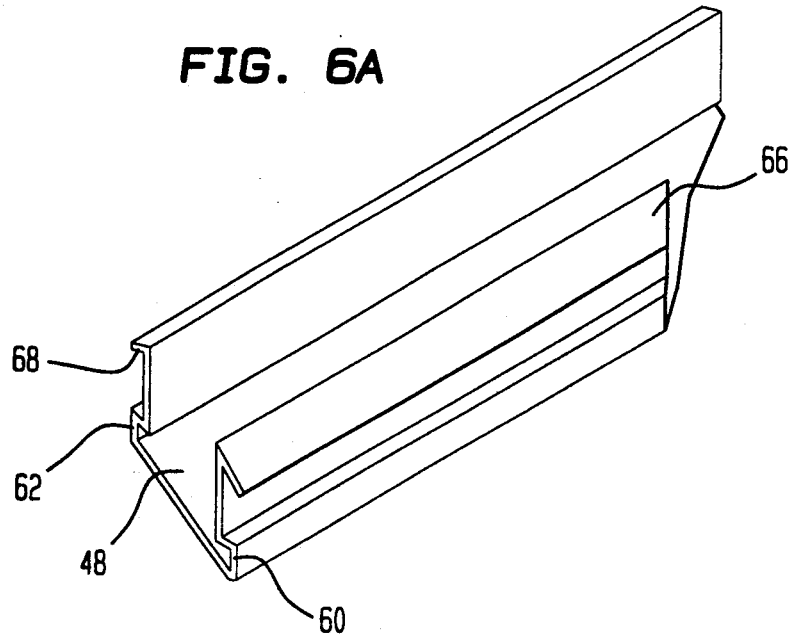
FIGS. 6A–6E are perspective illustrations of elements of the windows of FIGS. 1 and 4.
Figure 6C:
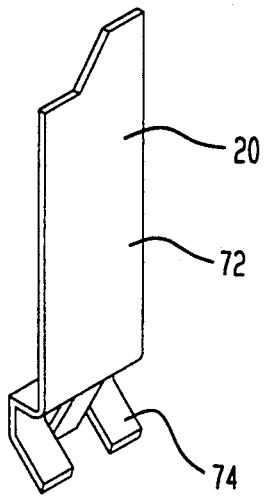
Figure 6B:
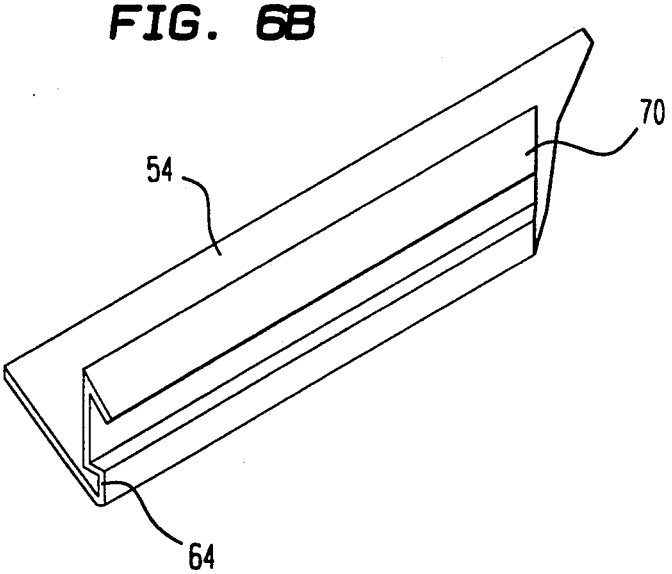
Figure 6D:
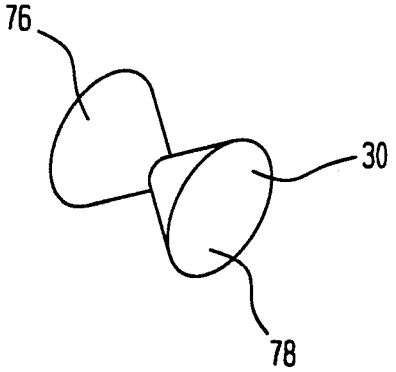

Connectors 30, best seen and described below with reference to FIG. 6D, provide interlocking between inner case 22 and peripheral case 24.

The inner case 22 comprises four members 32, 34, 36 and 38 having abutting end portions, for example, 32" and 38', 36' and 38". The peripheral case 24 comprises four members 40, 42, 44 and 46. The members 32–38 and 40–46 have a common profile as shown by bar 48 in FIG. 6A and have widths of between 30–80 mm and 75–130 mm, respectively, depending on the size of the window frame 10.

L-shaped fasteners 50 formed with a rectangular corner tab 51, best seen and described with reference to FIG. 6E, fasten, for example, end portions 32" and 38' of members 32 and 38, respectively, and end portions 36' and 38" of members 36 and 38, respectively.

A member 52, produced from a bar 54 shown in FIG. 6B, is provided to cover side face 53 of outer partition 28. Member 52 extends between and is interlocked to peripheral case members 42 and 46 by connectors 30.

Figure 5:
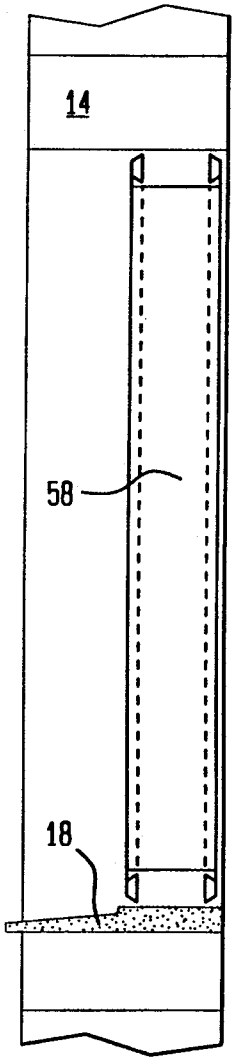
FIG. 5 is a cross-sectional illustration of the blind regular window frame of FIG. 4 taken along section line V—V.
Figure 4:
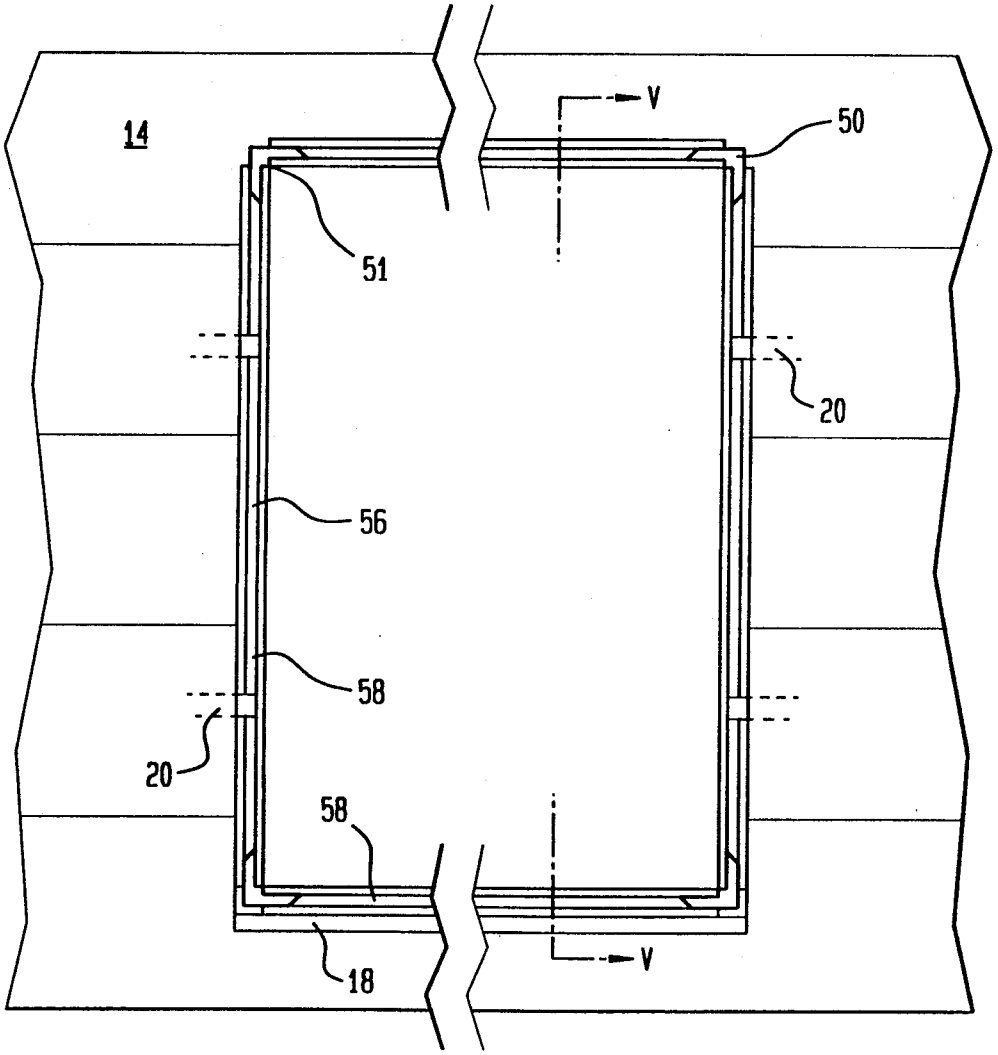
FIG. 4 is a front elevation illustration of a blind regular window frame, according to a second embodiment of the present invention.

FIGS. 4 and 5 illustrate a blind regular window frame 56 mounted on a sill 18 and installed in a wall 14. Window frame 56 is assembled from members 58 produced from bar 48 and fasteners 50.

The building block elements of the blind window frames 10 and 56, namely, the bars 48 and 54, the anchor 20, the connector 30 and the fastener 50 are now illustrated and described with reference to FIGS. 6A–6E.

FIGS. 6A and 6B illustrate the generally U-shaped and L shaped bars 48 and 54, respectively, each of which is preferably prepared from reels of flat galvanized steel by a process known in the art as "roll forming."

It is a particular feature of the invention that the bars 48, 54 have legs 60, 62 and 64, respectively, configured to provide railings 66, 68 and 70, respectively, which are adapted to receive parts of the other elements as will be described below. The railings are preferably dovetail-shaped having an extrapolated apex angle of between 60–90 degrees.

FIG. 6C illustrates the anchor 20 comprising a leg 72 and an open jaw-like end 74 configured to snugly fit into railings 66, 68 and 70.

FIG. 6D illustrates the connector 30 comprising two truncated cones 76 and 78 tapered to snugly fit into railings 66, 68 and 70.

Figure 6E:
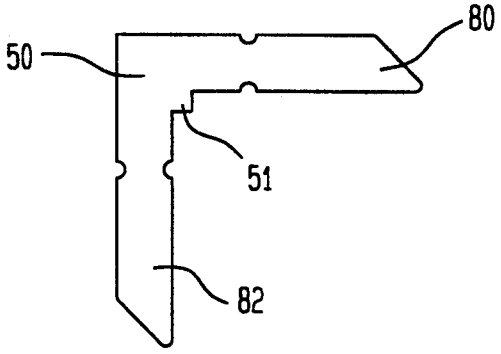

FIG. 6E illustrates the L-shaped fastener 50 comprising legs 80 and 82 flanged along their long sides to snugly fit into railings 66, 68 and 70. The fastener 50 ensures that two abutting window frame members are secured at substantially right angles to one another.

Figure 7:
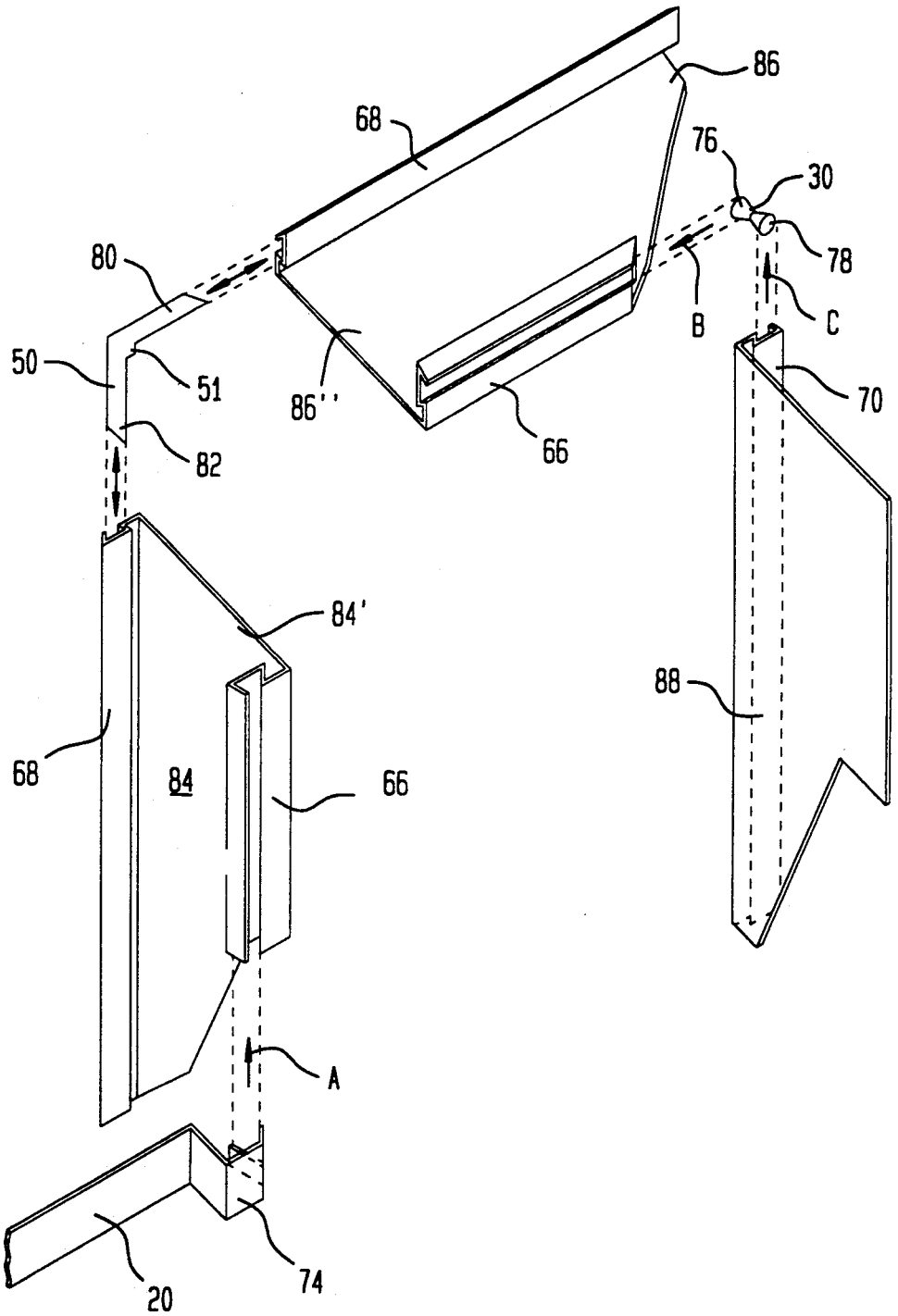
FIG. 7 is an exploded, perspective illustration of the assembly of the elements of FIGS. 6A–6E.

It is a particular feature of the invention that the above elements can be provided as an "off the shelf kit" thereby enabling a building contractor or workman to assemble blind window frames, similar to those shown in FIGS. 1 and 4, at a building site in a manner now described with reference to FIG. 7.

First, members 84, 86 and 88 are preferably cut or otherwise produced from bars 48 and 54, respectively, according to the wall opening 12 to be fitted with the blind pocket window frame.

Second, anchors 20 and connectors 30 are deployed as necessary depending on the size of the window frame, the type of wall, etc. Anchor 20 is inserted by aligning end 74 with railing 66. The anchor 20 is then slid along railing 66 of member 84 as shown by arrow A to its predetermined position where it is kept in place by crimping the railing 66 on either side thereof.

A connector 30 is used by aligning cone 76 with railing 66 of member 86, sliding it therealong as shown by arrow B to its predetermined position, and then threading railing 70 of member 88 onto cone 78 as shown by arrow C. Connector 30 is kept in place by crimping the railing 66 of member 86 and the railing 70 of member 88, respectively, on either side thereof.

It should be noted that inner case 22 and peripheral case 24 of window frame 10 (FIG. 1) are interlocked by means of connectors 30 in a similar manner to members 86 and 88. Thus, inner case 22 and peripheral case 24 are mounted adjacent and offset from one another, when assembled.

End portions 84' and 86" of members 84 and 86, respectively, are fastened together by inserting legs 80 and 82 of L-shaped fastener 50 into railings 68 thereof. The fasteners can be firmly secured in place by crimping the part of the railings overlying the legs of the fasteners. To construct a sturdier blind window frame, fasteners 50 are generally inserted into both railings 66 and 68 of a member.

The blind window frame is then secured to the wall by means of legs 72 of anchors 20 by methods known in the art.

It is a further particular feature of the invention that the assembly of a blind window frame according to the teachings of the present invention can be accomplished using minimal hand tools such as a saw, hammer and pliers by an unskilled laborer in approximately the same time as it used to take a skilled welder, thereby further reducing the unit cost of a blind window frame.

It will therefore be appreciated by persons skilled in the art that the present invention is not limited by what has been particularly shown and described hereinabove. Rather the scope of the invention is defined only by the claims which follow.

I claim:

1. A blind window frame for installation in a wall opening, said blind window frame comprising:

a multiplicity of substantially planar frame members each having a generally flattened U-shaped profile and end portions, with at least one leg configured to provide a dovetail-shaped external railing being open and facing away from said U-shaped profile, wherein the end portion of one of said frame members adjoins the end portion of another of said frame members; and fastening means for fastening said end portions of said adjoining members to one another;

wherein said fastening means comprises a generally L-shaped planar fastener having a vertex at an interior right angle whereat there is formed a rectangular corner tab protruding from said vertex, said rectangular corner tab defining an engagement position, said fastener having arms received by said adjoining window frame member railings aligned in a plane defined by said planar fastener such that said adjoining window frame members are fastened in said engagement position at substantially right angles to one another.

2. A blind window frame according to claim 1 further comprising a first and second set of said adjoining first set of said adjoining window frame members lying adjacent to said second set of said adjoining window frame members.

3. A blind window frame according to claim 2 wherein said interlocking means comprises a double, truncated cone connector having a pair of truncated cones wherein said truncated cones are received by said external railings of said first and second set of adjoining window frame members.

4. A blind window frame according to claim 1 further comprising anchoring means for anchoring said blind window frame to a wall.

5. A blind window frame according to claim 4 wherein said anchoring means comprises an anchor having an end configured to be received by said external railing of a window frame member and a leg to be attached to a wall.

6. A kit for assembling a blind window frame for installation in a wall aperture, said kit comprising:

a blind window frame bar having a generally flattened U-shaped profile, with at least one leg configured to provide a dovetail-shaped external railing being open and facing away from said U-shaped profile, a multiplicity of substantially planar frame members each having end portions being produced from said bar, wherein the end portion of one of said frame members adjoins the end portion of another of said frame members; and fastening means for fastening said end portions of said adjoining blind window frame members to one another to form a blind window frame;

wherein said fastening means comprises a generally L-shaped planar fastener having a vertex at an interior right angle whereat there is formed a rectangular corner tab protruding from said vertex, said rectangular corner tab defining an engagement position, said fastener having arms received by said adjoining window frame member railings aligned in a plane defined by said planar fastener such that said adjoining window frame members are fastened in said engagement position at substantially right angles to one another.

7. A kit according to claim 6 further comprising a first and second set of said adjoining window frame members and interlocking means for interlocking said first set of said adjoining window frame members lying adjacent to said second set of said adjoining window frame members, wherein said interlocking means comprises a double, truncated-cone connector having a pair of truncated cones wherein said truncated cones are received in said external railings of said first and second set of adjoining window frame members.

8. A kit according to claim 6 further comprising anchoring means for anchoring said blind window frame to the wall, wherein said anchoring means comprises an anchor having an end configured to be received by said external railing of a window frame member and a leg to be attached to a wall.

9. A method for assembling a blind window frame for installation in a wall aperture, said method comprising the steps of:

producing a multiplicity of substantially planar frame members from a blind window frame bar, each frame member having a generally flattened U-shaped profile and end portions, with at least one leg configured to provide a dovetail-shaped external railing open and facing away from said U-shaped profile;

adjoining the end portion of one of said frame members to the end portion of another of said frame members; and fastening said end portions of said adjoining window frame members to one another to form a blind window frame;

wherein said fastening step comprises providing a generally L-shaped planar fastener having a vertex at an interior right angle whereat there is formed a rectangular corner tab protruding from said vertex, said rectangular corner tab defining an engagement position, said fastener having arms received by said adjoining window frame member railings aligned in a plane defined by said planar fastener such that said adjoining window frame members are fastened in said engagement position at substantially right angles to one another.

10. A method according to claim 9 further comprising the step of anchoring the blind window frame to a wall by inserting an anchor into said external railing of a blind window frame member and sliding the anchor along said external railing to a predetermined position.

11. A method according to claim 10 further comprising the steps of;

providing a first and second set of said adjoining window frame members; and interlocking said first set of said adjoining window frame members lying adjacent to said second set of said adjoining window frame members.

12. A method according to claim 11 wherein the step of interlocking further comprising the steps of:

providing a connector;

inserting said connector into said external railing of a window frame member of said first set; and threading said external railing of a window frame member of said second set onto said connector.

13. A method according to claim 9 further comprising the step of crimping said external railing.

* * * * *